US006664873B2

(12) United States Patent
Tiihonen

(10) Patent No.: US 6,664,873 B2
(45) Date of Patent: Dec. 16, 2003

(54) TUNABLE RESONATOR

(75) Inventor: Markku J. Tiihonen, Oulu (FI)

(73) Assignee: Remec Oy, Oulu (FI)

( * ) Notice: Subject to any disclaimer, the term of this patent is extended or adjusted under 35 U.S.C. 154(b) by 0 days.

(21) Appl. No.: 09/922,542

(22) Filed: Aug. 3, 2001

(65) Prior Publication Data

US 2003/0025569 A1 Feb. 6, 2003

(51) Int. Cl.[7] ..... H01P 7/10

(52) U.S. Cl. ..... 333/219.1; 333/17.1; 333/202; 333/219.2; 333/197; 333/235; 333/212

(58) Field of Search ..... 333/219.1, 219.2, 333/17.1, 202, 235, 197–212

(56) References Cited

U.S. PATENT DOCUMENTS

| | | | | |
|---|---|---|---|---|
| 3,573,679 A | * | 4/1971 | Johnson | 333/226 |
| 4,028,652 A | | 6/1977 | Wakino et al. | |
| 4,136,320 A | | 1/1979 | Nishikawa et al. | |
| 4,138,652 A | | 2/1979 | Nishikawa et al. | |
| 4,578,655 A | | 3/1986 | Etienne et al. | |
| 4,623,857 A | | 11/1986 | Nishikawa et al. | |
| 4,636,756 A | * | 1/1987 | Ito et al. | 333/202 |
| 4,639,699 A | | 1/1987 | Nishikawa et al. | |
| 4,724,403 A | * | 2/1988 | Takayama | 331/96 |
| 4,810,984 A | | 3/1989 | Arnold et al. | |
| 4,937,533 A | * | 6/1990 | Livingston | 333/126 |
| 5,164,691 A | | 11/1992 | Wakino et al. | |
| 5,691,677 A | * | 11/1997 | De Maron et al. | 333/219.1 |
| 5,783,979 A | | 7/1998 | Andoh et al. | |
| 5,898,349 A | | 4/1999 | Hattori et al. | |
| 6,002,311 A | | 12/1999 | Wey et al. | |
| 6,072,378 A | | 6/2000 | Kurisu et al. | |
| 6,114,928 A | | 9/2000 | Smith | |
| 6,147,577 A | * | 11/2000 | Cavey | 333/209 |
| 6,362,708 B1 | * | 3/2002 | Woods | 333/234 |

OTHER PUBLICATIONS

Hunter et al., "Dual–Mode Filters with Conductor–Loaded Dielectric Resonators", *IEEE Transactions on Microwave Theory and Techniques, 47*(12) (Dec. 1999).

Nishikawa et al., "800 MHz Band Channel Dropping Filter Using $TM_{010}$ Mode Dielectric Resonator", *1984 IEEE MTT–S Digest*, May 29–Jun. 1, 1984, San Francisco, CA, No. 7–16, pp. 199–201.

Nishikawa et al., "800 MHz Band Dielectric Channel Dropping Filter Using $TM_{110}$ Triple Mode Resonance", *IEEE MTT–S Digest*, Jun. 4–6, 1985, St. Louis, MO, No. K–5, pp. 289–292.

Poplavko et al., "Frequency–Tunable Microwave Dielectric Resonator", *IEEE Transactions On Microwave Theory and Techniques, 49*(6), 1020–1026 (Jun. 2001).

Wang et al., "Dielectric Combline Resonators and Filters", *IEEE Transactions On Microwave Theory and Techniques, 46*(12), 2501–2506 (Dec. 1998).

Wang et al., "Dielectric Combline Resonators and Filters", 4 pgs. 1998 *IEEE*.

* cited by examiner

*Primary Examiner*—Michael Tokar
*Assistant Examiner*—Linh V Nguyen
(74) *Attorney, Agent, or Firm*—Heller Ehrman White & McAuliffe

(57) ABSTRACT

A tunable resonator is provided. The resonator includes a housing having a cavity. A resonator body is disposed adjacent to a first surface within the cavity. A gap is formed between the resonator body and the first surface. The resonator is tuned by controlling the size of the gap.

21 Claims, 6 Drawing Sheets

TUNABLE RESONATOR

TECHNICAL FIELD

The present invention relates generally to the field of filters and, in particular, to a tunable resonator for a filter.

BACKGROUND

Wireless telecommunications systems transmit signals to and from wireless terminals using radio frequency (RF) signals. A typical wireless system includes a plurality of base stations that are connected to the public switched telephone network (PSTN) via a mobile switching center (MSC). Each base station includes a number of radio transceivers that are typically associated with a transmission tower. Each base station is located so as to cover a geographic region known colloquially as a "cell." Each base station communicates with wireless terminals, e.g. cellular telephones, pagers, and other wireless units, located in its geographic region or cell.

A wireless base station includes a number of modules that work together to process RF signals. These modules typically include, by way of example, mixers, amplifiers, filters, transmission lines, antennas and other appropriate circuits. One type of filter that finds increased use in wireless base stations is known as a microwave cavity filter. These cavity filters include a number of resonators formed in a plurality of cavities so as to provide a selected frequency response when signals are applied to an input of the filter.

Each resonator in a filter is tuned to have a selected resonant frequency. Many techniques are conventionally available for remotely tuning the resonant frequency of these filters. These techniques include electromagnetic actuators and stepper motors. Unfortunately, these techniques each have limitations and drawbacks. For example, many of the remote tuning techniques have a limited tuning range or require large movement amplitudes to gain the required tuning range. Further, many of the remote tuning techniques are not reliable.

For the reasons stated above, and for other reasons stated below which will become apparent to those skilled in the art upon reading and understanding the present specification, there is a need in the art for an improved tunable resonator.

SUMMARY

The above-mentioned problems with tunable resonators and other problems are addressed by embodiments of the present invention and will be understood by reading and studying the following specification. Embodiments of the present invention provide a tunable resonator that is tuned by varying the size of a gap between a resonator body and a ground plane, or a portion of a ground plane, of the resonator.

More particularly, in one embodiment a tunable resonator is provided. The resonator includes a housing having a cavity. A resonator body is disposed adjacent to a first surface within the cavity. A gap is formed between the resonator body and the first surface. The resonator is tuned by controlling the size of the gap.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide improvements in tunable resonators for cavity filters. Embodiments of the present invention include a resonator body that is disposed either directly on, or very close to, a grounding structure of the resonator cavity. The resonator is tuned by varying the distance between the resonator body and the grounding structure or a part of the grounding structure. Advantageously, when the ground plane is very close to the resonator, only small variations in the distance between the resonator body and the ground plane, or part of the ground plane, are required to achieve a wide tuning range. This tuning technique is used, for example, with dielectric filters in which a dielectric block is located close to the ground plane. Examples of this kind of resonator include a Transverse Magnetic (TM) mode dielectric rod, a half cut Transverse Electric (TE) mode dielectric body, a quarter cut TE mode dielectric body, a TE mode x-resonator, any appropriate multi-mode dielectric body and a conductor loaded Hybrid mode (HE-mode) resonator body. Other resonator structures can also be used. Each of these resonator structures can be used in the embodiments shown in FIGS. 1–7 described in detail below.

With a resonator body mounted directly to, or in close proximity with, the conducting cavity surface, very small changes of the distance between the surface and the resonator cause significant change in the resonant frequency of the resonator. For example, it has been discovered that changing the distance from the 0 mm to 0.2 mm changes the resonant frequency over 200 MHz in some embodiments of the present invention.

Figure 1:
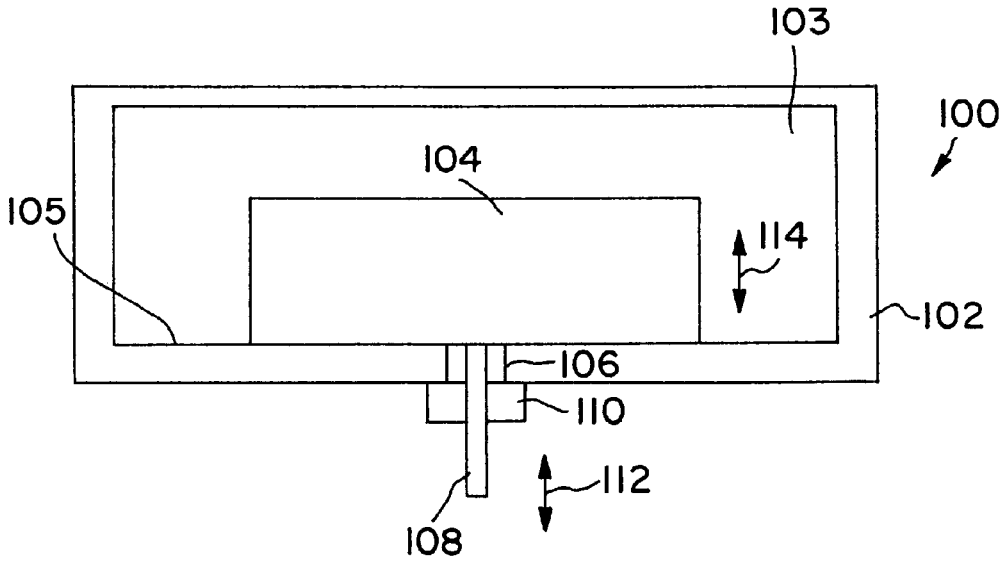
FIG. 1 is a cross-sectional view of a first embodiment of a tunable resonator constructed according to the teachings of the present invention.

FIG. 1 is a cross-sectional view of a first embodiment of a tunable resonator, indicated generally at 100, constructed according to the teachings of the present invention. Tunable resonator 100 includes housing 102. In one embodiment, housing 102 comprises a conductive, e.g., metal, shell having a cavity 103. The resonator body 104 is disposed within housing 102 in close proximity to surface 105. Surface 105 comprises a ground plane of resonator 100.

Tunable resonator 100 includes a mechanism for adjusting the resonant frequency of tunable resonator 100. This mechanism includes opening 106 in housing 102. Member or shaft 108 extends through opening 106 and is coupled to resonator body 104, e.g., a dielectric resonator body. In one embodiment, shaft 108 also extends through support 110 fastened to an exterior surface of housing 102. The position of shaft 108 in opening 106 is controlled by any appropriate mechanical actuator, e.g., a piezoelectric actuator, piezoelectric stack, piezoelectric multilayer, piezoelectric bimorph actuator, a stepper motor, a linear motor, a solenoid, and a magnetostrictive GMM material.

Figure 2:
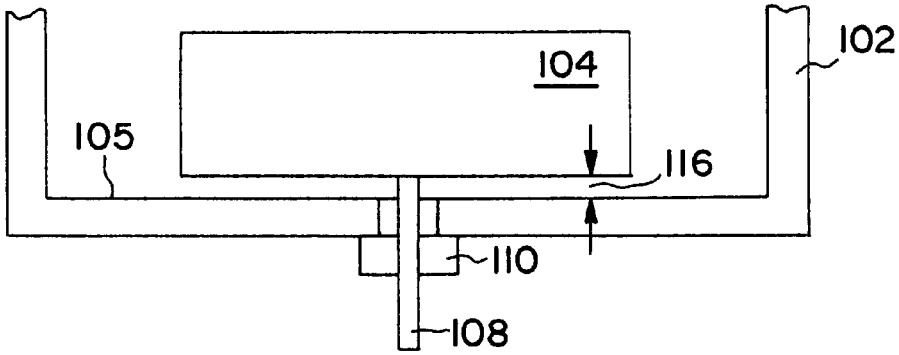
FIG. 2 is a partial cross-sectional view illustrating tuning of the first embodiment.

In operation, the resonant frequency of resonator 100 is adjusted by adjusting the size of a gap between resonator body 104 and the ground surface, e.g., surface 105. In this embodiment, this is accomplished by moving the relative position of resonator body 104 with respect to surface 105 as indicated by arrows 114. To accomplish this, shaft 108 moves in opening 106 as indicated by arrows 112. For example, as illustrated in FIG. 2, the resonant frequency of tunable resonator 100 is adjusted by moving resonator block 104 away from surface 105 to adjust the size of gap 116. When gap 116 increases, the resonant frequency also increases. Conversely, when gap 116 decreases the resonant frequency also decreases.

Figure 3:
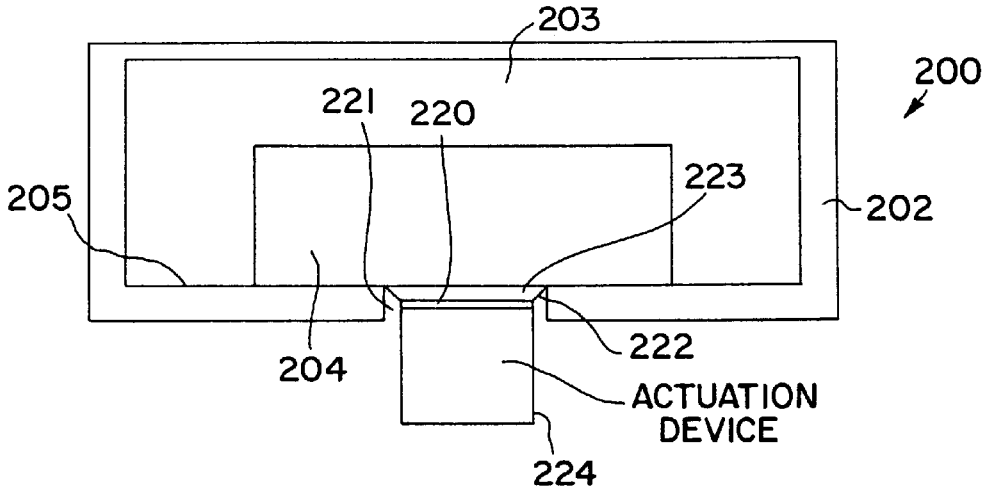
FIG. 3 is a cross-sectional two of a second embodiment of a tunable resonator constructed according to the teachings of the present invention.

FIG. 3 is a cross-sectional view of a second embodiment of a tunable resonator, indicated generally at 200, constructed according to the teachings of the present invention. Tunable resonator 200 includes housing 202 with cavity 203. Tunable resonator 200 further includes resonator body 204 that is disclosed on, or in close proximity to, surface 205 of housing 202.

Tunable resonator 200 further includes a mechanism for adjusting the resonant frequency of tunable resonator 200. This mechanism includes movable tuning plate 220 that moves within opening 221 of housing 202. In one embodiment, this mechanism includes an optional flexible membrane 222 that couples movable plate 220 to housing 202 within opening 221. In other embodiments, flexible membrane 222 is omitted and movable plate 220 is fitted to move within opening 221. In one embodiment, movable plate 220 and flexible membrane 222 comprise conductive material that are electrically connected to housing 202. In one embodiment, movable plate 220 and flexible membrane 222 are formed from the material of housing 202 using an appropriate machining process. In other embodiments, movable plate 220 and flexible membrane 222 are formed by forging, impact extrusion or from separate pieces that are joined together.

Movable plate 220 is separated from dielectric body 204 by gap 223. Movement of movable plate 220 adjusts the size of gap 223 and thereby adjusts the resonant frequency of tunable resonator 200.

Movement of movable plate 220 is controlled by actuation device 224. Actuation device 224 comprises one of a number of mechanical/electrical mechanisms for moving plate 220 within opening 221. For example, actuation device 224 comprises one of a piezoelectric actuator, piezoelectric stack, piezoelectric multilayer, piezoelectric bimorph actuator, a stepper motor, a linear motor, a solenoid, and a giant magnetostrictive material (GMM). In other embodiments, other appropriate to mechanical/electrical devices are used to control the position of movable plate 220. It is noted that when a piezoelectric actuator is used, in some embodiments, the actuator itself acts as the movable plate.

Figure 4:
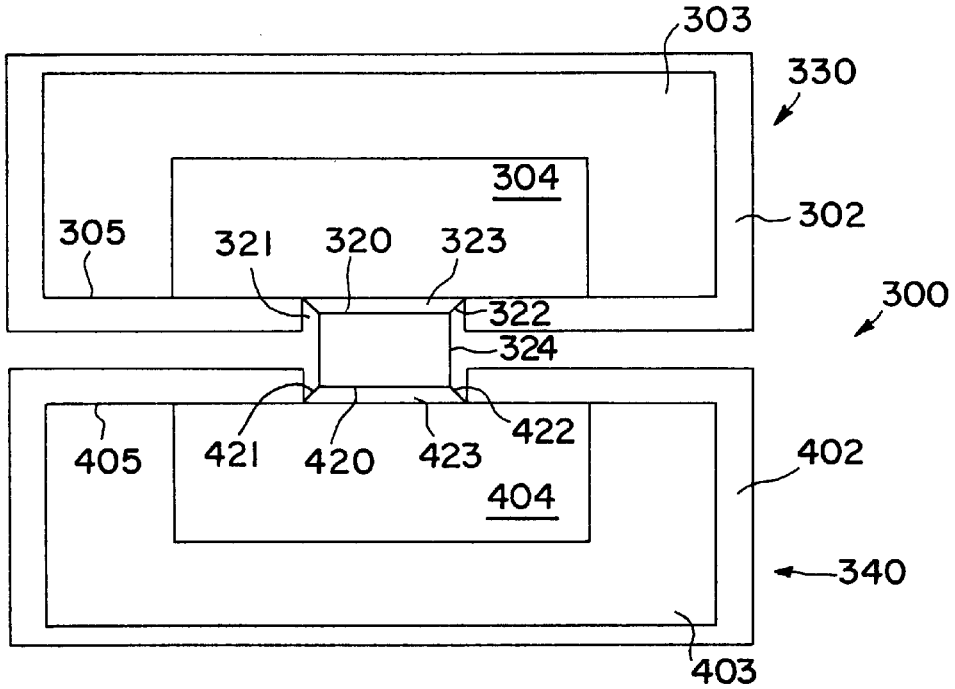
FIG. 4 is a cross-sectional view of an embodiment of a filter having tunable resonators according to the teachings of the present invention.

FIG. 4 is a cross-sectional view of an embodiment of a filter, indicated generally at 300, having tunable resonators 330 and 340 according to the teachings of the present invention. For sake of clarity, only the tuning mechanism for filter 300 is shown. Mechanisms for coupling signals between resonators to implement the filter have been omitted from the figure, but would be included in an implementation.

Filter 300 includes first and second tunable resonators 330 and 340, respectively. In this embodiment, tunable resonators 330 and 340 are disposed back to back to allow the two tunable resonators to share actuator 324 for simultaneously tuning resonators 330 and 340.

Resonator 330 includes conductive, e.g., metal, housing 302. Housing 302 forms cavity 303. Dielectric body 304 is disposed on, or in close proximity to, surface 305 of housing 302. Resonator 330 also includes a mechanism for tuning resonator 330. This mechanism includes movable plate 320 that is disposed within opening 321 of housing 302. In one embodiment, this mechanism further includes flexible membrane 322 that is coupled to housing 302 in opening 321 to allow movement of movable plate 320 and to provide contact with housing 302. In one embodiment, membrane 322 and movable plate 320 are formed from material of housing 302 by an appropriate machining process.

Similarly, resonator 340 includes conductive, e.g., metal, housing 402. Housing 402 forms cavity 403. Dielectric body 404 is disposed on, or in close proximity to, surface 405 of housing 402. Resonator 340 also includes a mechanism for tuning resonator 340. This mechanism includes movable plate 420 that is disposed within opening 421 of housing 402. In one embodiment, this mechanism further includes flexible membrane 422 that is coupled to housing 402 in opening 421 to allow movement of movable plate 420 and to provide contact with housing 402. In one embodiment, membrane 422 and movable plate 420 are formed from material of housing 402 by an appropriate machining process.

Resonators 330 and 340 share actuation device 324. Actuation device 324 is provided in contact with movable plates 322 and 422. Actuation device 324 controls the size of gap 323 of resonator 330 and gap 423 of resonator 340. Thus, actuation device 324 controls the resonant frequency of both resonators. In one embodiment, actuation device 324 provides similar displacement to both movable plates at the same time. For example, actuation device 324 simultaneously provides a force on movable plates 320 and 420 to move movable plates 320 and 420 toward their respective resonator bodies, e.g., bodies 304 and 404, or a force that moves plates 320 and 420 away from their respective resonator bodies. Advantageously, this reduces the number of parts necessary to control the frequency of filter 300.

Figure 5:
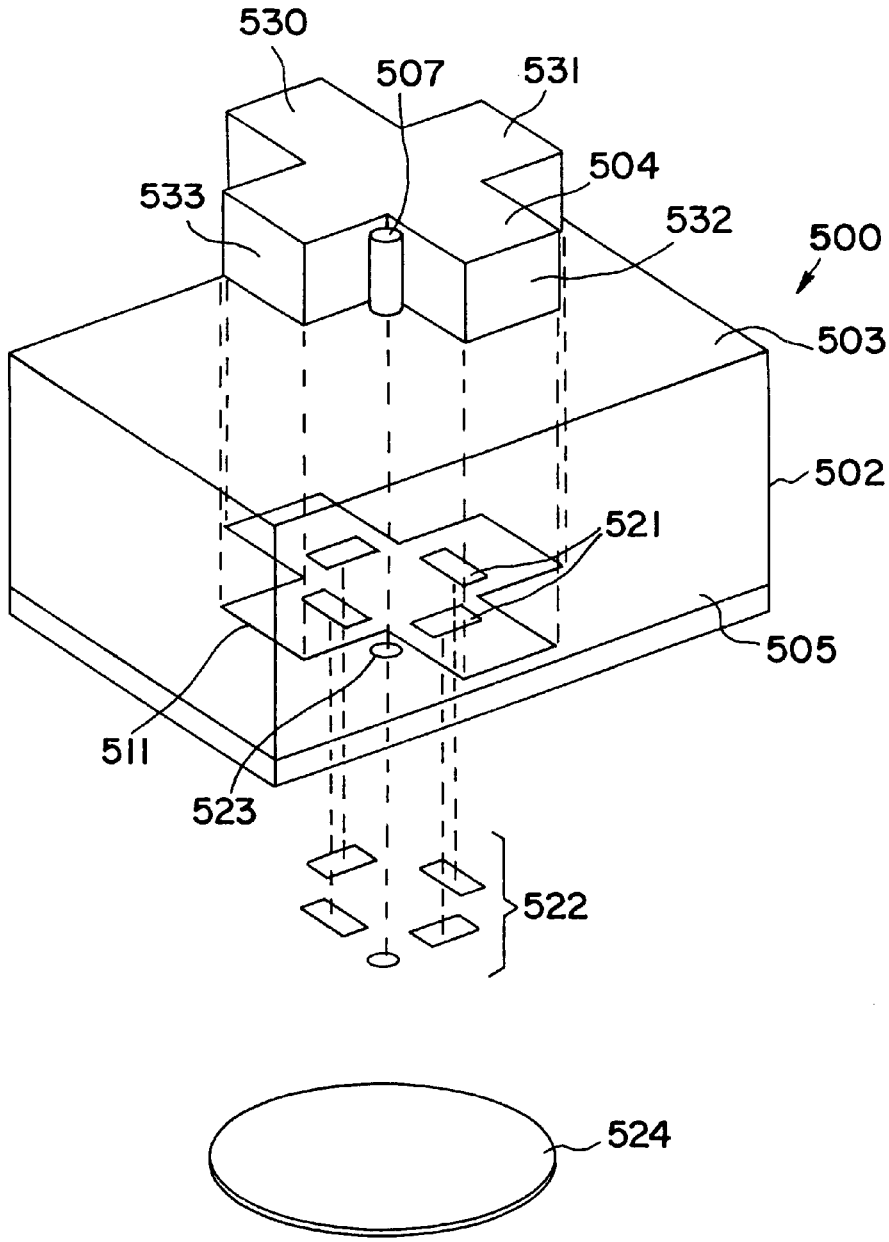
FIG. 5 is an exploded view of another embodiment of a tunable filter including a tunable x-resonator constructed according to teachings of the present invention.

FIG. 5 is an exploded view of another embodiment of a tunable filter, indicated at 500, including an x-resonator constructed according to teachings of the present invention. In this embodiment, filter 500 includes conductive, e.g., metal, housing 502 that forms cavity 503. Resonator body 504, e.g., a cross shaped dielectric body, is disposed on, or in close proximity to, surface 505 of housing 502 as indicated by outline 511.

Filter 500 includes a mechanism for tuning of the resonant frequency and the coupling between modes for filter 500. In this embodiment, this mechanism includes a plurality of openings 521 in surface 505 of housing 502. In one embodiment, these openings are positioned under members 530, 531, 532 and 533 of resonator body 504 as shown in FIG. 5. In other embodiments, openings 521 are provided in other orientations to allow an appropriate level of tuning for a given application. In one embodiment, an additional opening 523 is provided below mode coupling member 507. This allows for tuning of the mode coupling in a multimode resonator. In the embodiment of FIG. 5, only a single mode coupling member 507 is shown. It is understood that in other embodiments any appropriate number of mode coupling members 507 are incorporated with resonator body 504.

The tuning mechanism further includes a plurality of movable plates 522 with one movable plate provided for each opening in surface 505 of housing 502. In one embodiment, the movable plates each include a flexible membrane. In one embodiment, the movable plates 522 are formed from the material of housing 502. It is noted that the distance or gap between the movable plates 522 and resonator body 504 and mode coupling member 507 controls resonant frequencies and mode coupling, respectively.

Finally, the tuning mechanism includes actuation device 524. In one embodiment, actuation device 524 comprises a single actuation device for a plurality of movable plates 522 as shown in FIG. 5. In other embodiments, separate control for one or more of the movable plates is achieved by providing more than one, independent actuation device.

In operation, filter 500 provides an adjustable filter function. The filter function is adjusted by controlling the resonant frequencies provided by the resonator body. In this embodiment, the resonator body is a multimode resonator body with first and second modes that are coupled through mode coupling member 507. The resonant frequency of each of the modes and the mode coupling is controlled by adjusting the relative position of movable plates 522 within openings 521 of housing 502. As with the embodiments described above, movable plates 522 below resonator body 504 affect the resonant frequency of resonator 500 proportionate with the change in a gap between the respective plate and resonator body 504. For example, when the gap increases, the resonant frequency increases and when the gap decreases the resonant frequency also decreases. With respect movement of plates 522 relative to coupling member 507, the affect Varies based on the placement and number of coupling members. For example, when two coupling members 507 are located on adjacent corners of dielectric body 504, movement of plate 522 toward a first coupling member increases coupling and movement of plate 522 toward the second coupling member decreases the coupling.

Figure 6:
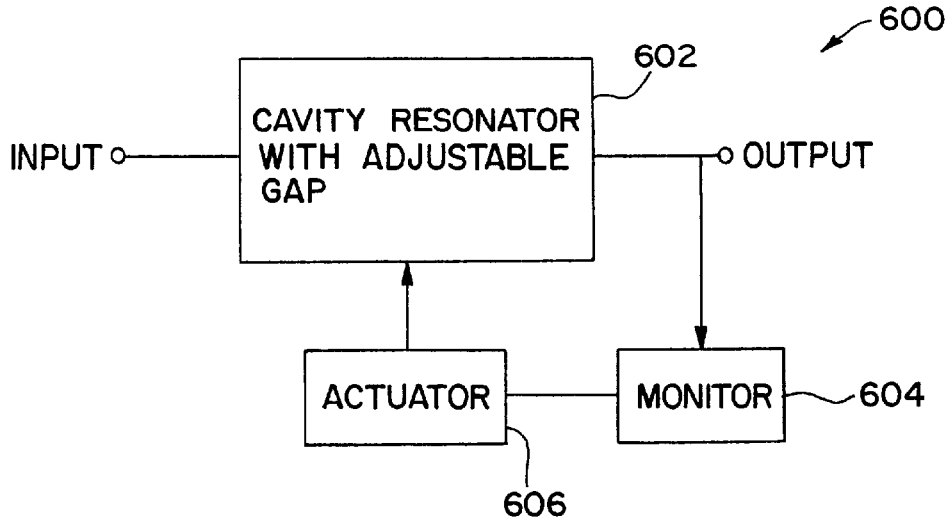
FIG. 6 is a block diagram of an embodiment of a tunable resonator with a control loop according to the teachings of the present invention.

FIG. 6 is a block diagram of an embodiment of a tunable resonator, indicated generally at 600, with a control loop according to the teachings of the present invention. Resonator 600 includes cavity resonator 602 that has a resonant frequency that is adjusted by controlling the distance between a resonator body and an interior surface of the cavity. For example, resonator 602, in one embodiment, comprises one of resonators or filters shown and described above with respect to FIGS. 1–5.

Resonator 600 further includes a control loop with monitor 604 and actuator 606. Monitor 604 is coupled to an output of cavity resonator 602. Monitor 604 is further coupled to control actuator 606. Actuator 606 is coupled to control the resonant frequency of resonator 602.

In operation, resonator 600 uses automatic feedback control to control the resonant frequency of resonator 602. Resonator 602 processes signals received at its input. At the output of resonator 602, monitor 604 monitors the output power and determines whether adjustments need to be made to the resonant frequency. If adjustments are required, monitor 604 provides control signals to actuator 606 to move the position of the resonator body of resonator 602.

Figure 7:
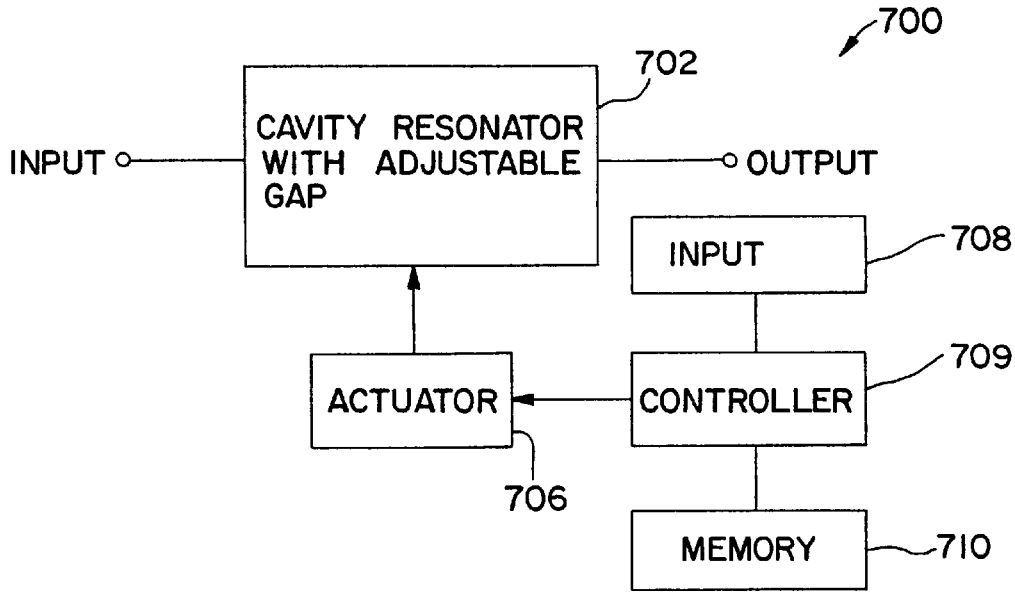
FIG. 7 is a block diagram of an embodiment of a tunable resonator according to the teachings of the present invention.

FIG. 7 is a block diagram of an embodiment of a tunable resonator, indicated generally at 700, according to the teachings of the present invention. Resonator 700 includes cavity resonator 702. Cavity resonator 702 has a resonant frequency that is adjusted by controlling the distance between a resonator body and an interior surface of the cavity of cavity resonator 702. For example, cavity resonator 702, in one embodiment, comprises one of the resonators or filters shown and described above with respect to FIGS. 1–5.

Resonator 700 includes a mechanism to select the resonant frequency of the resonator. This mechanism includes controller 704, e.g., a processor, logic circuit or other circuit that is capable of providing a control signal to adjust the resonant frequency of resonator 700. Controller 704 is coupled to input 708 and memory 710. Memory 710 comprises a circuit such as a memory device or other circuit that stores control values for setting the resonant frequency of resonator 700. Controller 704 is further coupled to actuator 706. Actuator 706 is coupled to selectively adjust a gap between a resonator body and a ground plane of cavity resonator 702 that sets the resonant frequency of resonator 700.

In operation, the resonant frequency of resonator 700 is established based on an input received at input 708. Based on the input, controller 704 selects an appropriate control signal from memory 710. This control signal is applied to actuator 706. Actuator 706 uses the control signal to establish the size of a gap in cavity resonator 702 to control the resonant frequency of resonator 700.

Advantageously, resonator 700 can be preset with values stored in memory 710 for resonant frequencies for a plurality of service bands. Based on the pre-set values, an end user can configure the resonator as a filter for a specific service operating in one of the bands, e.g., analog AMPS, digital, PCS, GSM, or other appropriate cellular or PCS service.

Figure 8:
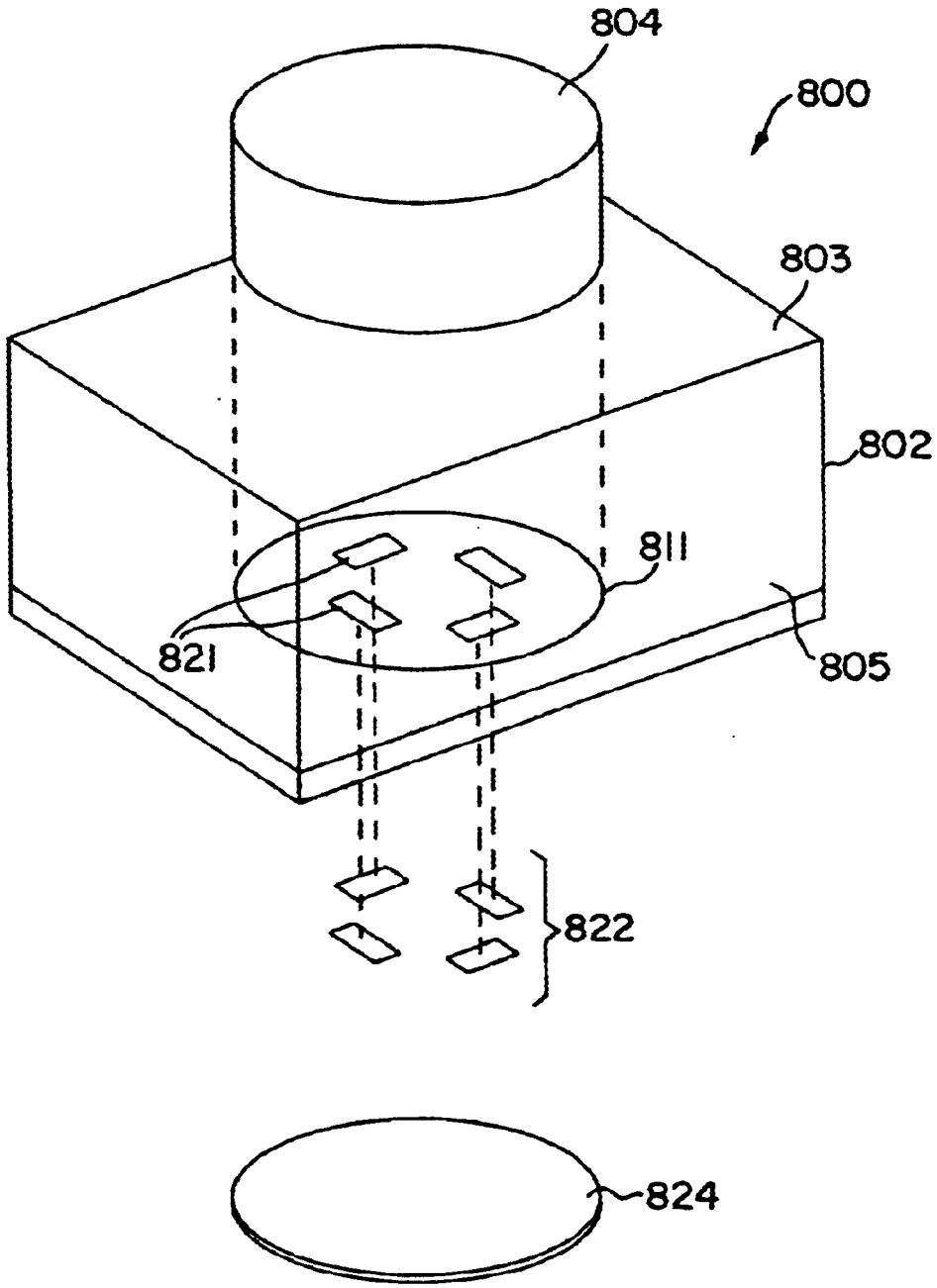
FIG. 8 is an exploded view of another embodiment of a tunable filter including a tunable multi-mode resonator constructed according to teachings of the present invention.

FIG. 8 is an exploded view of another embodiment of a tunable filter, indicated at 800, including a multi-mode resonator constructed according to teachings of the present invention. In this embodiment, filter 800 includes conductive, e.g., metal, housing 802 that forms cavity 803. Resonator body 804, e.g., a dielectric body, is disposed on, or in close proximity to, surface 805 of housing 802 as indicated by outline 811. Resonator body 804 is shown as a round body. However, in other embodiments, resonator body 804 comprises any other appropriate multimode resonator body.

Filter 800 includes a mechanism for tuning of the resonant frequency of the various modes of filter 800. In this embodiment, this mechanism includes a plurality of openings 821 in surface 805 of housing 802. In one embodiment, these openings are positioned under selected portions of resonator body 804 as shown in FIG. 8. In other embodiments, openings 821 are provided in other orientations to allow an appropriate level of tuning for a given application.

The tuning mechanism further includes a plurality of movable plates 822 with one movable plate provided for each opening in surface 805 of housing 802. In one embodiment, the movable plates each include a flexible membrane. In one embodiment, the movable plates 822 are formed from the material of housing 802. It is noted that the distance or gap between the movable plates 822 and resonator body 804 controls the resonant frequencies of the various modes.

Finally, the tuning mechanism includes actuation device 824. In one embodiment, actuation device 824 comprises a single actuation device for a plurality of movable plates 822 as shown in FIG. 8. In other embodiments, separate control for one or more of the movable plates is achieved by providing more than one, independent actuation device.

In operation, filter 800 provides an adjustable filter function. The filter function is adjusted by controlling the resonant frequencies provided by the resonator body. In this embodiment, the resonator body is a multimode resonator body. The resonant frequency of each of the modes is controlled by adjusting the relative position of movable plates 822 within openings 821 of housing 802. As with the embodiments described above, movable plates 822 below resonator body 804 affect the resonant frequency of resonator 800 proportionate with the change in a gap between the respective plate and resonator body 804. For example, when the gap increases, the resonant frequency increases and when the gap decreases the resonant frequency also decreases.

Figure 9:
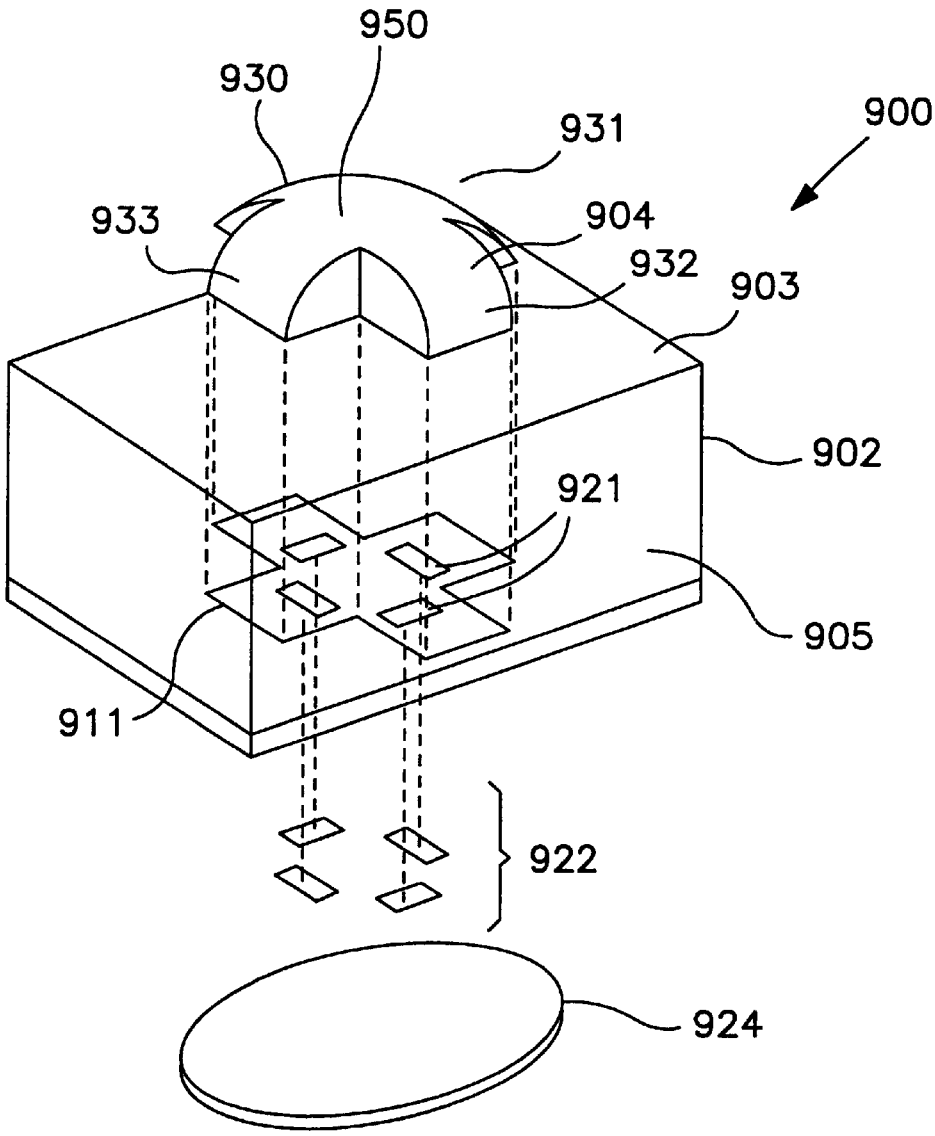
FIG. 9 is an exploded view of another embodiment of a tunable filter including a tunable multi-mode resonator constructed according to teachings of the present invention.

FIG. 9 is an exploded view of another embodiment of a tunable filter, indicated at 900, including an x-resonator constructed according to teachings of the present invention. In this embodiment, filter 900 includes conductive, e.g., metal, housing 902 that forms cavity 903. Resonator body 904, e.g., a cross shaped dielectric body with rounded top surface 950, is disposed on, or in close proximity to, surface 905 of housing 902 as indicated by outline 911:

Filter 900 includes a mechanism for tuning of the resonant frequency of the various modes for filter 900. It is noted that in other embodiments, mode coupling mechanisms are also included, such as those shown in FIG. 5 above. In this embodiment, the frequency tuning mechanism includes a plurality of openings 921 in surface 905 of housing 902. In one embodiment, these openings are positioned under members 930, 931, 932 and 933 of resonator body 904 as shown in FIG. 9. In other embodiments, openings 921 are provided in other orientations to allow an appropriate level of tuning for a given application.

The tuning mechanism further includes a plurality of movable plates 922 with one movable plate provided for each opening in surface 905 of housing 902. In one embodiment, the movable plates each include a flexible membrane. In one embodiment, the movable plates 922 are formed from the material of housing 902. It is noted that the distance or gap between the movable plates 922 and resonator body 904 controls the resonant frequencies.

Finally, the tuning mechanism includes actuation device 924. In one embodiment, actuation device 924 comprises a single actuation device for a plurality of movable plates 922 as shown in FIG. 9. In other embodiments, separate control for one or more of the movable plates is achieved by providing more than one, independent actuation device.

In operation, filter 900 provides an adjustable filter function. The filter function is adjusted by controlling the resonant frequencies provided by the resonator body. In this embodiment, the resonator body is a multimode resonator body. The resonant frequency of each of the modes is controlled by adjusting the relative position of movable plates 922 within openings 921 of housing 902. As with the embodiments described above, movable plates 922 below resonator body 904 affect the resonant frequency of resonator 900 proportionate with the change in a gap between the respective plate and resonator body 904. For example, when the gap increases, the resonant frequency increases and when the gap decreases the resonant frequency also decreases.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention.

What is claimed is:

1. A resonator, comprising:

a housing having a cavity and constructed of a non-dielectric material;

an opening in the housing;

a resonator body disposed in the cavity and covered the opening in the housing; and a movable tuning plate, disposed in the opening of the housing formed by the non-dielectric material, the plate adapted to be moved within the opening to control a distance between the plate and the resonator body to tune a resonant frequency of the resonator.

2. The resonator of claim 1, wherein the resonator body comprises a dielectric resonator body.

3. The resonator of claim 1, wherein the resonator body comprises one of a dielectric block, a Transverse Magnetic (TM) mode dielectric rod, half cut Transverse Electric (TE) mode dielectric body, a quarter cut TE mode dielectric body, a TE mode x-resonator, a multi-mode dielectric body, and a conductor loaded Hybrid-mode (HE-mode) resonator body.

4. The resonator of claim 1, and further comprising an actuator coupled to the tuning plate for controlling the position of the resonator body within the cavity.

5. The resonator of claim 4, wherein the actuator comprises one of a piezoelectric actuator, piezoelectric stack, piezoelectric multilayer, piezoelectric bimorph actuator, a stepper motor, a linear motor, a solenoid, and a giant magnetostrictive material (GMM).

6. The resonator of claim 4, and further comprising a control loop coupled to the actuator that controls the operation of the actuator based on the resonator frequency of the resonator to provide automatic feedback control of the resonator.

7. The resonator of claim 1, and further comprising a control loop that monitors the resonant frequency of the resonator and selectively controls a position of the tuning plate so as to dynamically control the frequency response of the resonator.

8. The resonator of claim 1, and further comprising a flexible membrane that couples the tuning plate to the housing within the opening in the housing.

9. The resonator of claim 1, wherein the tuning plate comprises a conductive material that is coupled electrically to the housing.

10. The resonator of claim 1, wherein the tuning plate comprises a portion of a piezoelectric actuator.

11. The resonator of claim 1, wherein the tuning plate is formed from the housing.

12. A resonator comprising:

a housing having a cavity and constructed of a non-dielectric material;

an opening in the housing;

a resonator body disposed in the cavity and fixed to a surface of the housing so as to cover the opening in the housing; and a movable tuning plate, disposed in the opening of the housing formed by the non-dielectric material, the plate adapted to be moved within the opening to control a distance between the plate and the resonator body to tune a resonant frequency of the resonator.

13. The resonator of claim 12, wherein the resonator body comprises a dielectric resonator body.

14. The resonator of claim 12, wherein the resonator body comprises one of a dielectric block, a Transverse Magnetic (TM) mode dielectric rod, half cut Transverse Electric (TE) mode dielectric body, a quarter cut TE mode dielectric body, a TE mode x-resonator, a multi-mode dielectric body, and a conductor loaded Hybrid Mode (HE)-mode resonator body.

15. The resonator of claim 12, and further comprising an actuator coupled to the tuning plate for controlling the position of the tuning plate within the cavity.

16. The resonator of claim 15, wherein the actuator comprises one of a piezoelectric actuator, piezoelectric stack, piezoelectric multilayer, piezoelectric bimorph actuator, a stepper motor, a linear motor, a solenoid, and a giant magnetostrictive (GMM) material.

17. The resonator of claim 15, and further comprising a control loop coupled to the actuator that controls the operation of the actuator based on the resonator frequency of the resonator to provide automatic feedback control of the resonator.

18. The resonator of claim 12, and further comprising a control loop that monitors the resonant frequency of the resonator and selectively controls a position of the tuning plate so as to dynamically control the frequency response of the resonator.

19. The resonator of claim 12, and further comprising a flexible membrane that couples the tuning plate to the housing within the opening in the housing.

20. The resonator of claim 12, wherein the tuning plate comprises a conductive material that is coupled electrically to the housing.

21. The resonator of claim 12, wherein the tuning plate comprises a portion of a piezoelectric actuator.

* * * * *

UNITED STATES PATENT AND TRADEMARK OFFICE

CERTIFICATE OF CORRECTION

PATENT NO. : 6,664,873 B2
DATED : December 16, 2003
INVENTOR(S) : Markku J. Tiihonen It is certified that error appears in the above-identified patent and that said Letters Patent is hereby corrected as shown below:

Title page,
Item [56], References Cited, U.S. PATENT DOCUMENTS, insert the following:
-- 4,613,838 * 09/1986 Wada et al. 333/232 --.

Column 2,
Line 1, please delete “two” and insert -- view --;

Column 4,
Line 48, “322 and 422” should read -- 320 and 420 --;

Column 6,
Line 21, “controller 704” should read -- controller 709 --;
Lines 23, 27 and 33, “Controller 704” should read -- Controller 709 --;

Column 8,
Line 21, “covered” should read -- covering --;
Line 38, “resonator body” should read -- tuning plate --.

Signed and Sealed this

Twentieth Day of April, 2004

JON W. DUDAS
*Acting Director of the United States Patent and Trademark Office*